US005121877A

United States Patent [19]

Bodary et al.

[11] Patent Number: 5,121,877

[45] Date of Patent: * Jun. 16, 1992

[54] STACKABLE CONTAINER FOR RIPENING OF FRUIT DURING SHIPMENT AND STORAGE

[75] Inventors: Michael G. Bodary, Cincinnati; Stephen E. Moorman, Bowling Green, both of Ohio

[73] Assignee: Chiquita Brands, Inc., Cincinnati, Ohio

[ * ] Notice: The portion of the term of this patent subsequent to Aug. 7, 2007 has been disclaimed.

[21] Appl. No.: 563,254

[22] Filed: Aug. 6, 1990

Related U.S. Application Data

[63] Continuation-in-part of Ser. No. 405,526, Sep. 12, 1989, Pat. No. 4,946,093.

[51] Int. Cl.[5] ..... B65D 5/68

[52] U.S. Cl. ..... 229/120; 229/23 BT; 229/125.19; 206/503

[58] Field of Search ..... 229/125.19, 125.26, 229/125.27, 23 BT, 23 R, 120; 206/503

[56] References Cited

U.S. PATENT DOCUMENTS

| | | | |
|---|---|---|---|
| 2,021,234 | 11/1935 | Gomes | 229/45 |
| 2,618,937 | 11/1952 | Francis | 62/91.5 |
| 2,739,734 | 3/1956 | Pugh | 220/83 |
| 2,774,230 | 12/1956 | Kasser | 62/169 |
| 2,801,742 | 8/1956 | Farrell | 206/65 |
| 2,864,545 | 12/1958 | Royce | 229/23 |
| 2,957,597 | 10/1960 | Royce | 217/42 |
| 2,973,127 | 2/1961 | Royce | 229/6 |
| 3,008,625 | 11/1961 | Cook . | |
| 3,108,731 | 10/1963 | Royce | 229/14 |
| 3,157,345 | 11/1964 | George | 229/229 |
| 3,331,529 | 7/1967 | Slapnik | 220/97 |
| 3,369,728 | 2/1968 | Royce . | |
| 3,393,858 | 7/1968 | Heel . | |
| 3,575,311 | 4/1971 | Etienne et al. | 217/42 |
| 3,655,114 | 4/1972 | Turner | 229/30 |
| 3,907,194 | 9/1975 | Davenport et al. | 229/23 |
| 4,474,324 | 10/1984 | Forbes, Jr. | 229/23 |
| 4,513,907 | 4/1985 | Grossheusch | 229/23 |
| 4,580,718 | 4/1986 | Muise | 229/48 |
| 4,597,503 | 7/1986 | Lates | 220/83 |
| 4,946,093 | 8/1990 | Moorman | 229/125.19 |

FOREIGN PATENT DOCUMENTS

| | | |
|---|---|---|
| 1190953 | of 0000 | France . |
| 2383838 | 3/1977 | France . |

*Primary Examiner*—Stephen Marcus
*Assistant Examiner*—Christopher J. McDonald
*Attorney, Agent, or Firm*—Fish & Richardson

[57] ABSTRACT

A container for ripening of fruit during storage and shipment has a first portion defining vertically oriented first side surfaces and a second portion defining vertically oriented second side surfaces, the planes of the first side surfaces being offset from planes of the second side surfaces. The container is adapted to be stacked in a pallet load with other of the containers, with adjacent first side surfaces of adjacent containers in engagement for stable stacking of the containers, and adjacent second side surfaces of adjacent containers spaced apart in a manner to define a channel between the adjacent containers for circulation of ventilating air or gas to fruit contained within the containers and for removal of heat generated by respiration of the fruit.

13 Claims, 7 Drawing Sheets

STACKABLE CONTAINER FOR RIPENING OF FRUIT DURING SHIPMENT AND STORAGE

This application is a continuation-in-part of U.S. Ser. No. 405,526, filed September 12, 189, now U.S. Pat. No. 4,946,093.

BACKGROUND OF THE INVENTION

The invention relates to corrugated containers which are used in handling, processing and shipment of fruit, such as bananas.

Bananas produce large quantities of heat during the ripening process due to respiration. The final quality of bananas is greatly influenced by pulp temperature of the fruit during ripening. Therefore, bananas must be kept refrigerated at a control temperature. The refrigeration process must have the capacity to be able to accurately control pulp temperature, or the quality of the fruit will deteriorate, requiring that the refrigeration system do the following: (1) completely remove the heat of respiration from the load, (2) absorb any heat that flows into the room through the walls or that is generated by mechanical equipment, and (3) enable pulp temperature to be reduced at a reasonable rate.

The optimum pulp temperature for maintaining freshness is 58° F. For maximum product shelf life, only during the commercial ripening cycle may the temperature be allowed to rise slightly above this 58° F. level. After the ripening cycle is complete, pulp temperature must be lowered back to 58° F. If pulp temperature rises to a higher temperature, shelf life is reduced. Excessively high pulp temperatures can cause "cooked" fruit, i.e. fruit having soft pulp and tender peels that split and break at the neck. High temperatures may also delay the desired color change from green to yellow.

Temperatures below 56° F. will result in the bananas becoming chilled. If the temperature of chilled bananas is brought up to normal, the bananas will ripen normally, but the color will appear dull and the quality will be perceived as low.

In order that the fruit arrive at the point of sale in marketable condition, it is imperative that the conditions, e.g. of temperature, to which the fruit is subjected during shipment and storage be carefully controlled and regulated. For example, bananas are typically packed in cardboard containers at the plantation where they were harvested in a very green, unripened state, and shipped via refrigerated ships which keep the bananas at a temperature between 56° and 59° F. Once a refrigerated ship dock, the banana containers are carefully unloaded and stacked on pallets in refrigerated trucks or rail cars. En route to a warehouse, the pulp temperature of the bananas is checked repeatedly to ensure that it meets a specified temperature upon arrival. When the trucks reach the warehouse, the banana containers are again unloaded and stacked on pallets in ripening rooms. As a part of the ripening process, it is imperative that the banana containers be stacked with the side and end walls spaced apart in a manner to provide channels between containers for flow of air and gas. Various methods used to stack the banana containers include a "three block pattern," a "four block open chimney pattern", and a "pyramid stack." Although banana containers typically include apertures to allow flow of gas and air through the container, a full pallet load of existing shipping containers does not provide for effective air flow, and it is necessary to place the containers in one of the above cooling pallet patterns or in another pattern which incorporates a chimney allowing heat to escape. This typically requires that the containers be restacked from the pallet to create a chimney to permit air flow, causing additional handling which results in bruising and scarring of the fruit. Furthermore, the chimney stacking of the containers is not efficient pallet usage, so the containers must be re-palletized after ripening, again resulting in additional bruising and scarring of the fruit.

Once the banana containers are stacked on pallets in the ripening room, the pulp temperature is permitted to increase to 60°–62°, and then ethylene gas is introduced into the ripening room and circulated through the containers to reduce the time necessary for the bananas to ripen fully. After the gas is cleared from the ripening room, the pulp temperature of the bananas is reduced and held until the bananas are shipped for delivery to the marketplace.

The handling requirements for other fruits are similar. For example, respirating fruits, e.g. such as tomatoes, may be ripened by control of the atmosphere.

Most current banana cartons employed at present are full telescoping, half-slotted containers (HSC), including a lid and base of approximately equal depth, the lid telescopically fitting over the base to complete the container. Another form of container used for the handing and storage of fruit is formed on a die cut machine, with multi-panel score lines cut in a blank to make a corrugated design of carton referred to in the industry as a "die cut tray". Other designs in use require a stitch in the panels to maintain infolded panels of the tray in a set-up condition. Other containers used for handling and processing fruit are two-piece telescopic containers consisting of a full height base and telescopically fitting top of substantially equal height. The base and lid are provided with vent apertures, slots or the like to enable circulation of gas and air through the container wall, over the fruit.

SUMMARY OF THE INVENTION

According to the invention, a container for ripening of fruit during storage and shipment comprises a first portion defining a plurality of vertically oriented first side surfaces and a second portion defining a plurality of vertically oriented second side surfaces, planes of the first side surfaces being offset from planes of the second side surfaces, the container being adapted for stacking in a pallet load with other of the containers, with adjacent first side surfaces of adjacent containers disposed in engagement for stable stacking of the containers, and adjacent second side surfaces of adjacent containers spaced apart in a manner to define channels between adjacent containers for circulation of gas to fruit contained within the containers.

Preferred embodiments of the invention may include one or more of the following features. The container comprises a box having a box bottom wall, box side walls and box end walls defining a volume with an open end, the box side walls defining the second side surfaces, and a lid for the box having a top wall and an integral perimeter comprised of lid side walls and lid end walls depending therefrom to fit telescopically over the open end of the box, the lid side walls defining the first side surfaces, the lid side walls and lid end walls being two-ply comprised of inner and outer panels, the outer panels being hingedly connected to the lid top wall and the inner panels being hingedly connected to the outer panels at a perimeter fold-line, the inner panels being folded inwardly about the perimeter fold-line, each of the inner panels having a hinged connection to the adjacent panel at a panel fold-line, the panel fold-line forming the inner corner of the lid perimeter wall, scored diagonal fold-lines radiating outwardly at the ends of each panel from the intersection of the perimeter fold-line and the panel fold-line, the included angle between the diagonal fold-lines being 90 degrees, the inwardly folded inner panels of the lid perimeter wall being locked at the corners by the diagonal folds and the inwardly folded panels being bowed inwardly of the lid perimeter whereby the bowed inner panels engage the box side walls and securely hold the lid on the box against the box side walls and reinforce the box side walls against bulging outwardly. The container further comprises apertures defined in the box bottom wall, box side walls and box end walls for ventilating flow of air through the box and apertures defined in the lid side walls and lid end walls for flow of air (and gas) into the box through the lid, the apertures of the lid walls being adjacent the perimeter fold line for the panels forming the lid top wall. The lid top wall defines a central opening and the box bottom wall defines a central opening for flow of air (and gas) through the container. The lid is formed of a blank comprising alternating side flaps and end flaps hinged along one of their sides at a first longitudinal fold-line, the side flaps and end flaps being separated from each other from the fold-line to one longitudinal edge of the blank, a second longitudinal fold line parallel with the first, lateral fold-lines extending from the first longitudinal fold-line to the other longitudinal edge of the blank, the lateral fold-lines defining alternative side panels and end panels and a tab, the tab being disposed at the end of the blank providing a manufactures joint for fastening the blank into a closed perimeter of the lid, the second longitudinal fold-line forming side-by-side inner and outer panels disposed lengthwise along one side of the blank, two diagonal fold lines provided by scores in the blank extending from the intersection of each lateral fold-line and the second longitudinal fold line to the adjacent other longitudinal edge of the blank, the two diagonal fold-lines having an included angle of 90 degrees and each extending 45 degrees from the second longitudinal fold line, the diagonal fold lines, together with the lateral fold-line adapted to provide a gusset-style corner for the lid upon folding the lid inner panels inwardly about the second longitudinal fold-line. Preferably, the blank defines a plurality of apertures are formed along the first longitudinal fold line, each the aperture extending into the adjacent flaps and into the outer panels, more preferably the plural apertures comprise an aperture located at each of the flap, and the apertures are centered on the first longitudinal fold line, and the inner panels and outer panels are substantially equal in width, the inner panels having cut out portions along the edge of the blank located to register with the apertures upon folding the inner flaps along the second longitudinal fold line, the apertures being elongated, oval shaped die cut apertures bisected by the first longitudinal fold line and cut out portions along the edge of the blank are substantially equal to half the oval shaped apertures. The lid comprises a lid top wall, a pair of spaced lid side walls and a pair of spaced lid end walls, the lid side walls and lid end walls being in adjacent relationship, each lid side wall and lid end wall being formed from inner and outer panels joined to each other at their sides along a longitudinal fold line, and joined to each other at their ends at a lateral fold-line to define the corner of the lid, each of the inner panels having a diagonal fold-line extending interiorly of the panel and intersecting the lateral fold-line, the diagonal fold-lines between adjacent inner panels having an included angle of 90 degrees, the inner panels being connected continuously and folded inwardly about the longitudinal fold-line to form a two-ply perimeter wall of the lid, the diagonal fold-lines and lateral fold-line at the ends of the inner panels providing a hinged joint for locking the inner panels in place such that the inner panels bow inwardly toward the center of the lid. Preferably, the inner panels of the lid engaging the box side walls and box end walls to provide a snug fit over the walls of the box and firmly support the walls of the box against bulging. More preferably, the panels of the lid extend over the box side walls and box end walls for a part of their vertical height when the box is closed, e.g., the panels of the lid extend approximately one half the vertical height of the box side walls and box end walls, and the box side walls and box end walls have apertures for flow of air through the box and the panels of the lid perimeter wall are die cut to provide apertures at the sides and ends of the lid perimeter wall.

Other features and advantages of the invention will be seen from the following description of a presently preferred embodiment, and from the claims.

DESCRIPTION OF A PRESENTLY PREFERRED EMBODIMENT

We first briefly describe the drawings.

Drawings

FIG. 1 is a perspective view showing a pallet load of containers of the invention in use, while

Figure 1:
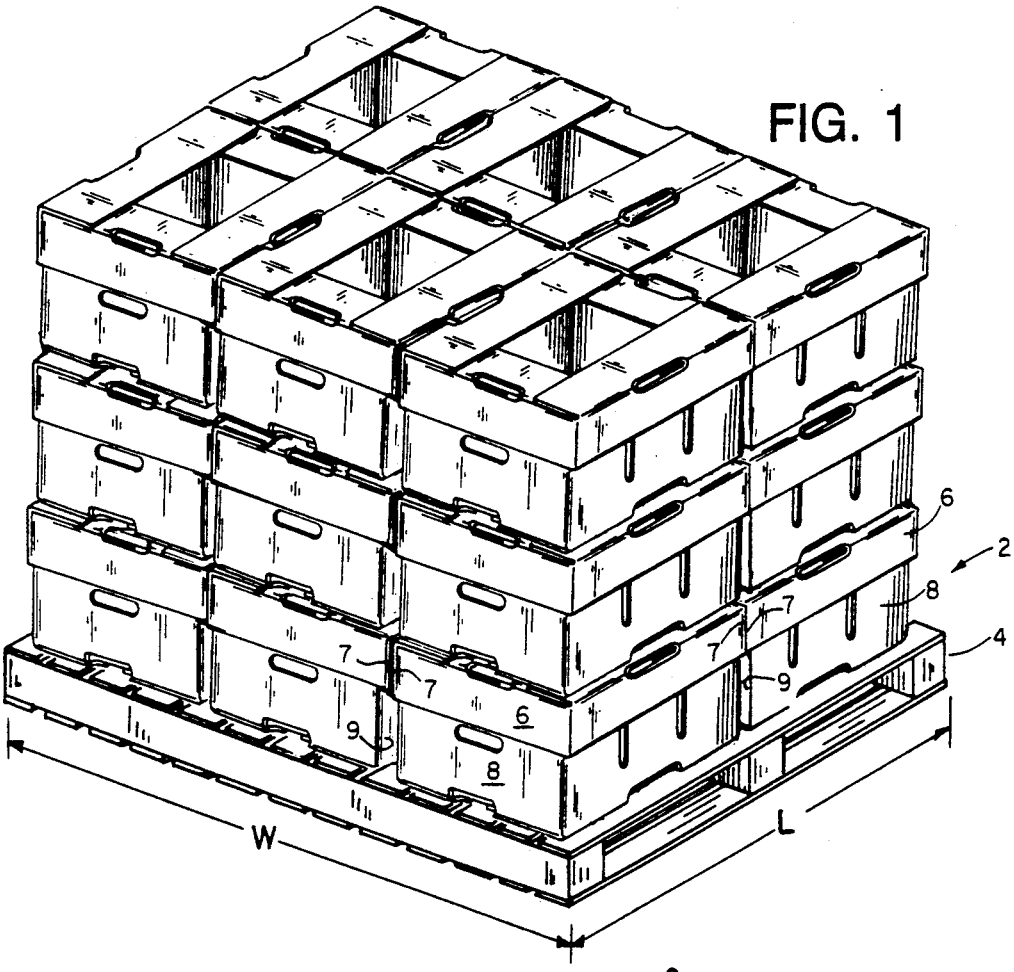
Figure 1A:
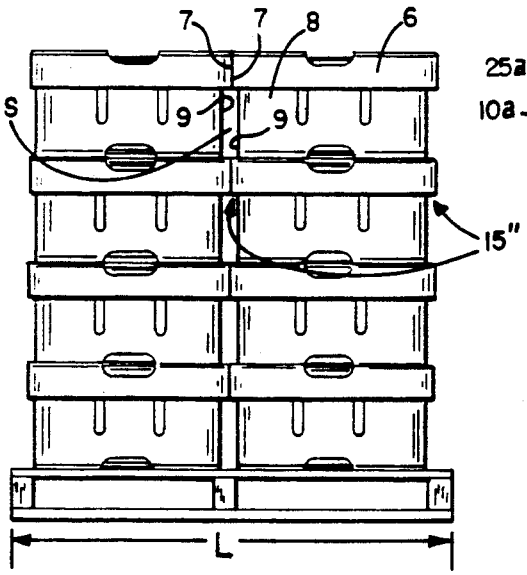
FIGS. 1A and 1B are side and face views of the pallet load of containers of FIG. 1.
Figure 1B:
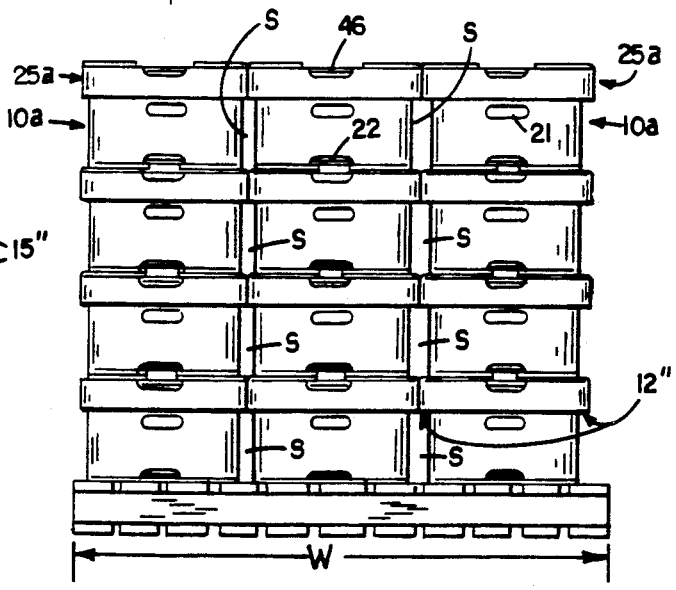

Referring to the drawings, and specifically FIGS. 1, 1A and 1B, a plurality of containers 2 of the invention are stacked on a pallet 4 of width W and length L, e.g. 36 inches by 30 inches. The containers consist of a lid 6 disposed in telescoping relationship upon a box 8. The lid of each container overhangs the sides of the corresponding box, so that, with the containers in stacked relationship upon the pallet, the adjacent side surfaces 7 of adjacent lids 6 are in close engagement to provide stable stacking of the containers upon the pallet, while the adjacent side surfaces 9 of adjacent boxes 8 (in which there are defined apertures 20, 21, 46) are spaced apart to provide channels S between the containers on the pallet. The channels permit the removal of heat caused by respiration of the fruit from between the containers. The channels also permit the circulation of air and the minute amount of ethylene gas required to trigger ripening. Heat is also removed and air and gas are circulated through the apertures into the containers to maintain the temperature of the fruit at a uniform, controlled level for control and consistency of the ripening process.

Referring to FIGS. 1A and 1B, the channels S run longitudinally of the three boxes as well as laterally of the two boxes in the typical pallet load shown. (The pallet load is typically eight tiers in height, however, for ease of illustration only four layers of the pallet load are shown by way of example.)

In addition to channeling effect, the containers of the invention provide enhanced support through the 2-ply perimeter side walls of the lid which support the ends and especially the sides of the container against bulging outwardly. Furthermore, the inherent boxing inwardly of the inner panels of the lid toward the center of the box provides a secure package for the produce.

The box and lid described are readily manufactured by standard box-making equipment, employing die cut and scoring elements. The placement of the vent openings and apertures of the preferred embodiment of the container of the invention provide maximum strength of the container by the placement of the aperture in relation to the direction of the corrugations in the corrugated paperboard.

Figure 2C:
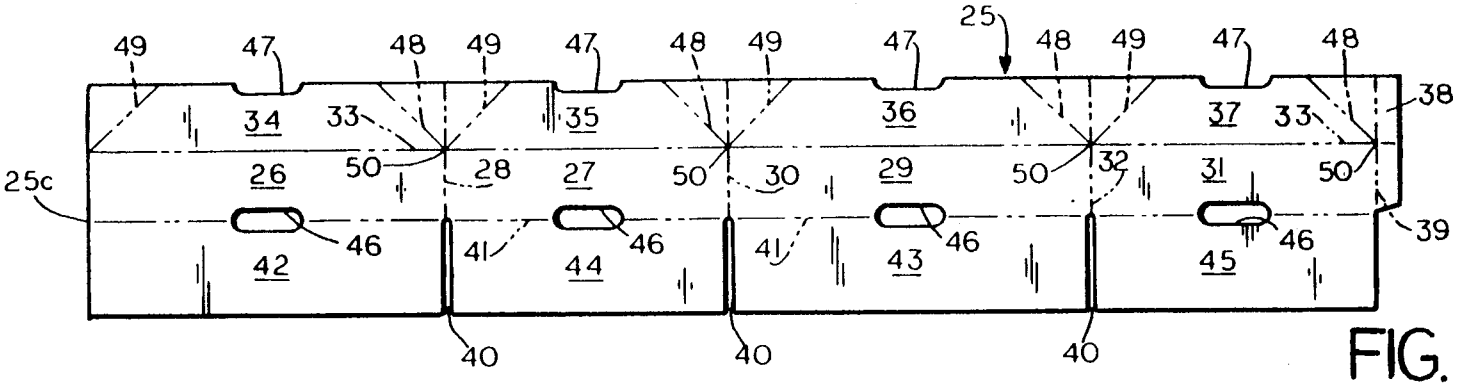
FIGS. 2A, 2B and 2C are plan views of blanks for a top or lid of the container of the invention having a single wall, a double wall, and a double wall with gusset style corners, respectively.
Figure 2:
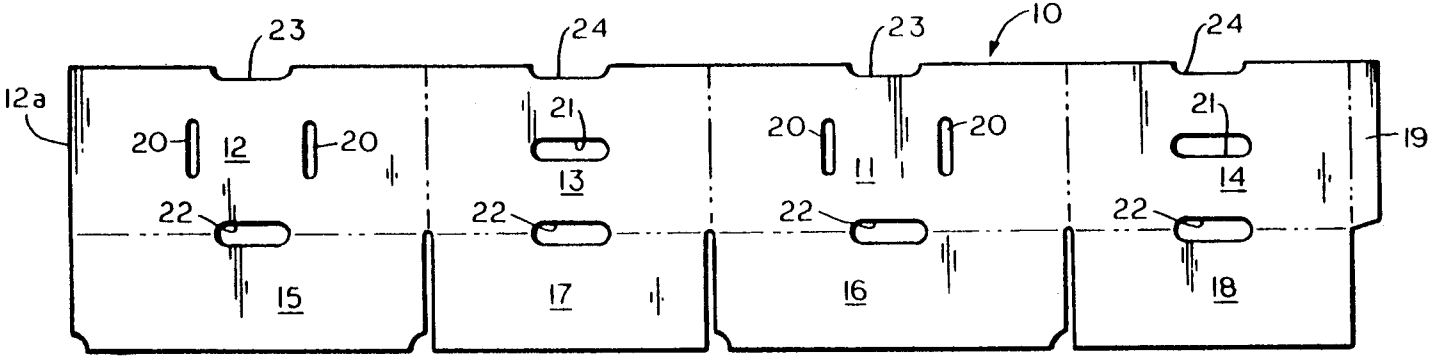
FIG. 2 is a plan view of a blank for a half-slotted container body (the bottom of the container)

Referring now to FIG. 2 et seq., a lower box is erected from a die cut blank 10 of corrugated paperboard, or like paper product. Blank 10 is a HSC (half-slotted container) blank which includes two side panels 11 and 12 hingedly connected to two end panels 13 and 14. Bottom side flaps 15 and 16 are hingedly connected along longitudinal score lines to side panels 11 and 12, respectively, and bottom end flaps 17 and 18 are connected similarly to the end panels 13 and 14. The bottom flaps 15–18 are of the same width which is equal to one-half of the length of end panels 13 and 14 or less. The flaps are separated by slots between them, which extend the width dimension of the flaps to the fold-line hinge for the flaps 15–18 on the panels 11–14. End panel 14 includes a tab 19 extending along the outer edge of the end panel. When the panels are folded along their respective fold-lines to form a rectangular shape, tab 19 is attached by adhesive, staples or other suitable means to the inside surface of the side panel 12 adjacent its free edge 12*a*.

For assembly of the bottom or box 8 of the container, the bottom side flaps 15 and 16 are folded upwardly and inwardly. Next the bottom end flaps 17 and 18 are folded upwardly and inwardly to lie in surface contact with the side flaps 15 and 16. The bottom flaps are fastened together by adhesive or staples to form an open-topped box 8 as shown on FIGS. 3 and 4. The opposite outer corners of the side flaps 15 and 16 have circular cut outs of a radius that enables the flaps when folded inwardly to form the bottom wall of the box to conform to the bottom end openings 22 of the box (see FIG. 3).

The side panels 11 and 12 each are provided with plural elongated openings 20 punched from the material which allow air flow into the box and across the box. The end panels 13 and 14 are each provided with a larger elongated opening 21 which allow air flow into the box and lengthwise of it and also provide hand holes at the end of the box for lifting. Each of the bottom flaps and side wall panels of the blank 10 have an elongated opening 22 formed centrally and along the fold-line such that the fold bisects each opening 22. Along the longitudinal edge of blank 10 opposite the bottom flaps are die cut segments or cut-out areas 23 and 24 which are centered, respectively, on the longitudinal outer edge of the panels 11 and 12 and panels 13 and 14. These cutouts 23 and 24 are each of the same longitudinal dimension as the die cut openings 22. The cut-outs 23 and 24 cooperate with die cut openings in the lid 6 (to be described later) forming air flow passages along the top of the container.

Figure 2A:
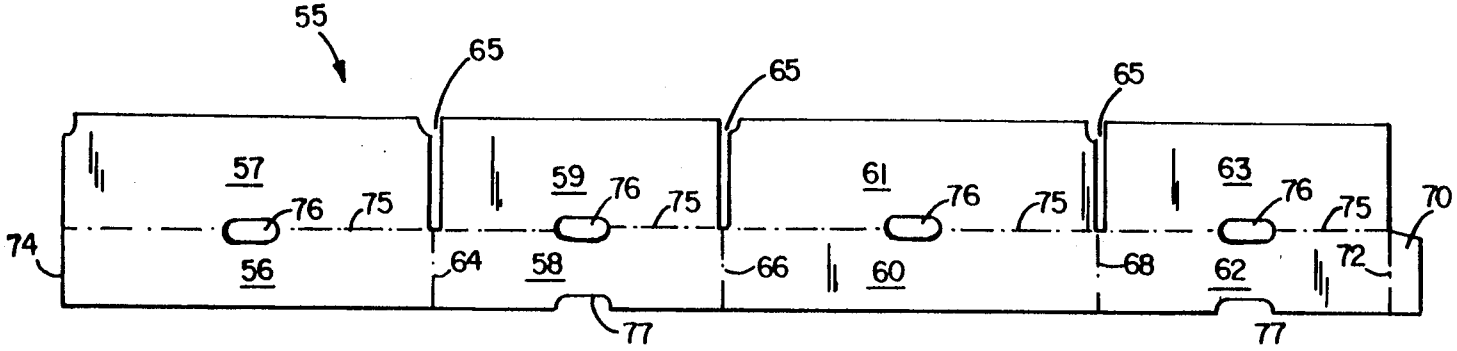
Figure 2B:
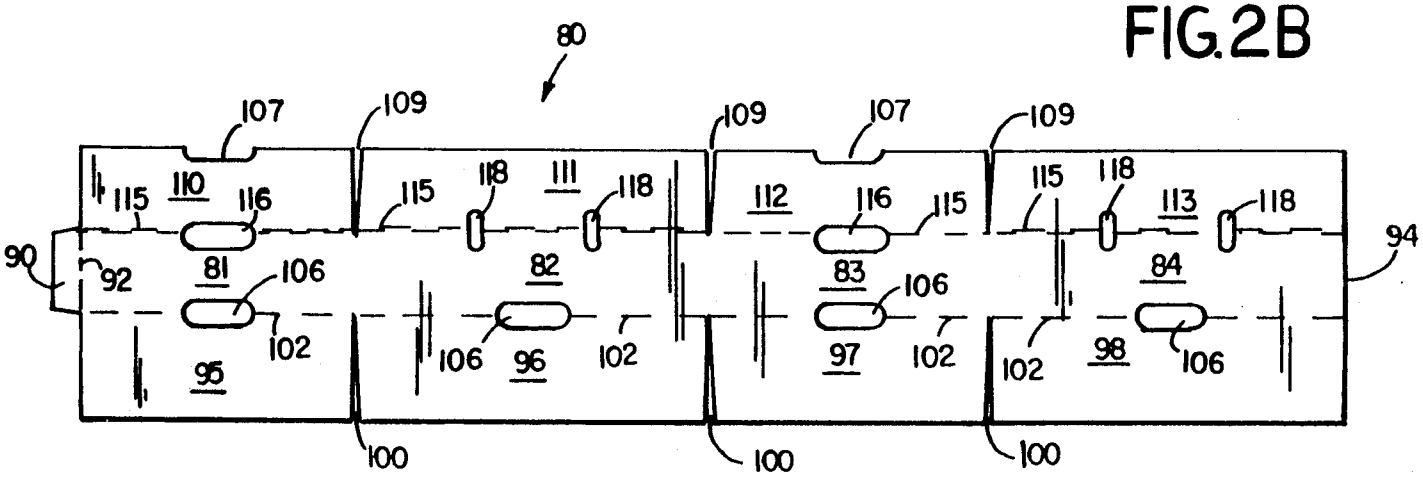

Referring to FIGS. 2A–2C of the drawings, a single wall lid, a double wall lid, and a double wall lid having gusset style corners are shown. Each is formed from a blank die cut of corrugated paperboard or like material, and is described in turn below.

Figure 6C:
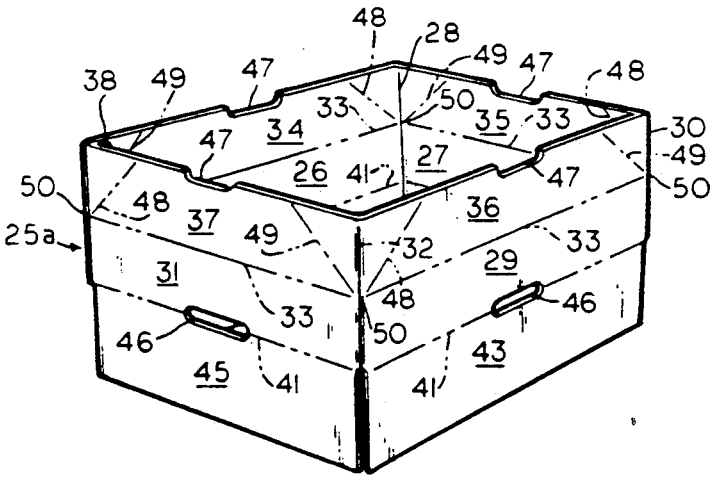
FIGS. 6A, 6B and 6C are perspective views of the lid blanks of FIGS. 2A, 2B and 2C showing a further stage of assembly in which the manufacturer's joint is fastened and the lid is fitted over the HSC container.
Figure 6A:
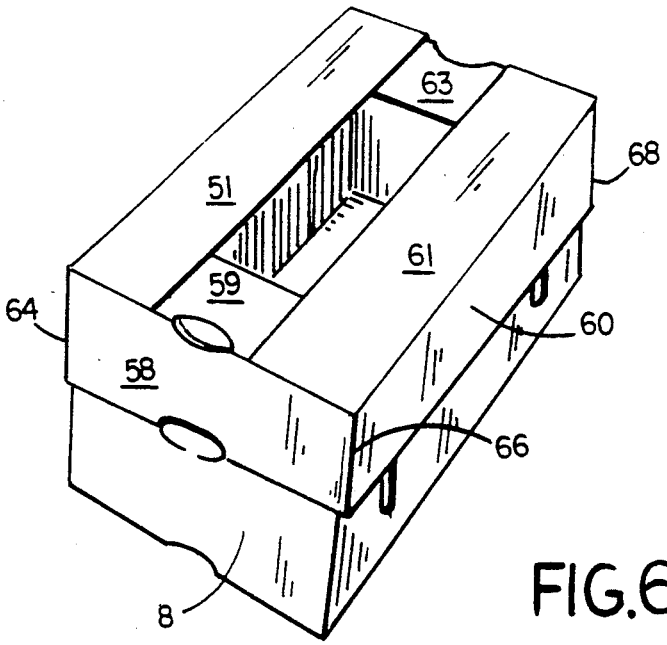

Referring to FIG. 2A, the single wall lid is formed of a blank 55 which has an outer side panel 56 and an adjacent outer end panel 58 hinged along a fold-line 64; the outer end panel 58 is joined to an outer side panel 60 along a fold-line 66; and the outer side panel 60 is hinged to an adjacent outer end panel 62 along a fold-line 68. A tab 70 is joined to the outer end panel 62 along a fold-line 72 and provides a manufacturer's joint for assembling the lid blank 55 to a rectangular shape. Upon folding the blank 55 at the fold-lines 66 and 72, the tab 70 is secured by adhesive or other means along the free transverse edge 74 of the outer side panel 56 to a flattened shape. As shown in FIG. 6A, this flattened shape is squared to a rectangular shape hinged at the corners by fold-lines 64, 66 and 68.

Blank 25 further includes flaps 57, 59, 61 and 63 which are separated by slots 65 extending from the free edge of the blank transversely to the longitudinal fold-line 75 extending around the perimeter of the lid. The side flaps 57 and 61 lie adjacent to the end flaps 59 and 63. To complete assembly of the lid, the flaps 57–63 are folded inwardly to form the top of the lid and secured. Each of the flaps 57–63 and outer panels 56–62 have die cut oval shaped elongated openings 76, each of which is centered longitudinally of the respective flaps and panels and the fold-line 75 bisects the openings 76. Additionally, there are cut-out areas 77 disposed along the longitudinal free edge of the blank, one centered on each of the outer end panels 58 and 62. The cut-outs 77 correspond to half of the openings 76 and are positioned to register with the openings 76 upon folding the outer panels inwardly along the perimeter fold-line 75.

Figure 6B:
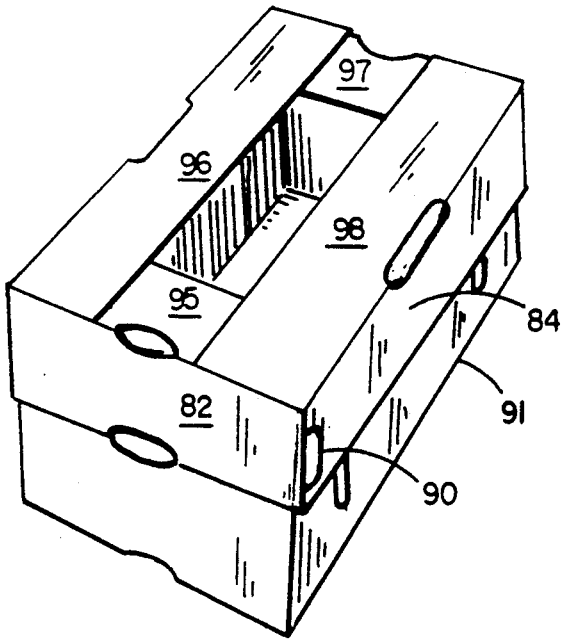
Figure 7:
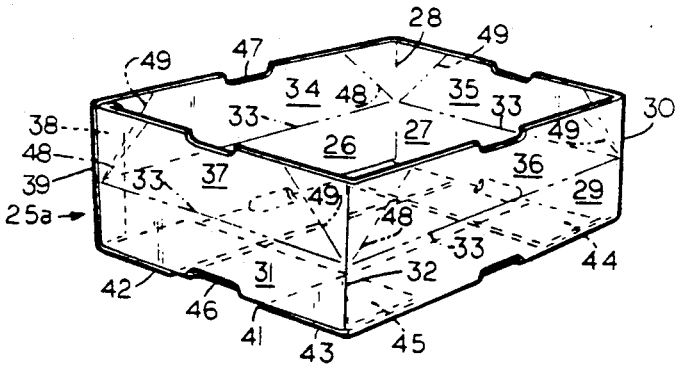
FIGS. 7 through 9 are perspective views of the lid shown in FIG. 6C showing the panels folded closed at one end and the panels of the other end being folded inwardly to lock the outer panels in place.
Figure 8:
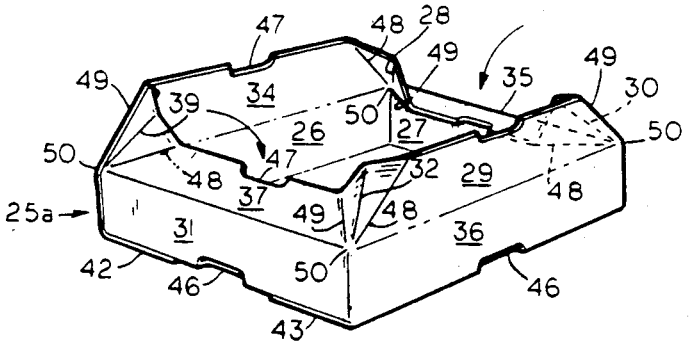
Figure 9:
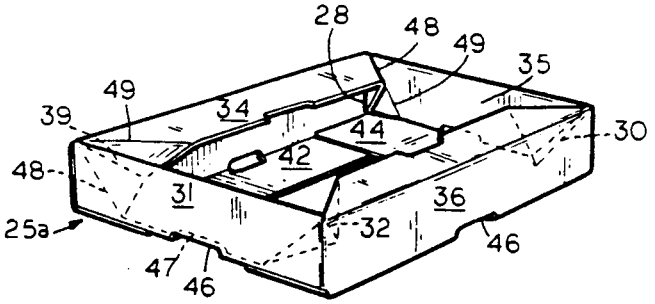
Figure 10:
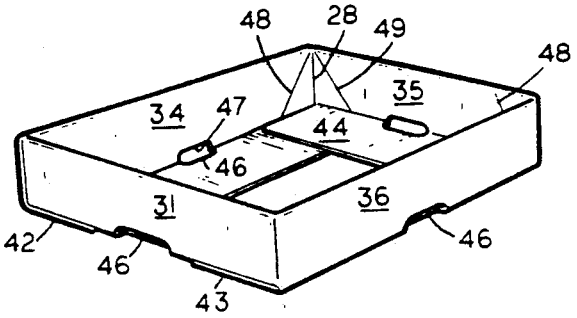
FIG. 10 is a perspective view of the lid shown in FIG. 6C in assembled condition ready for use with the bottom box as shown on FIGS. 3 and 4.

Referring to FIG. 2B, the double wall lid is similarly formed of a blank 80 which has an end outer wall panel 81 and an adjacent side outer wall panel 82 hinged along a fold-line 85; the outer wall panel 82 is joined to an end outer wall panel 83 along a fold-line 86; and the outer wall panel 83 is hinged to an adjacent side outer wall panel 84 along a fold-line 87. A tab 90 is joined to the outer wall panel 81 along a fold-line 92 and provides a manufacturer's joint for assembling the lid blank 80 to a rectangular shape. Upon folding the blank 80 at the fold-line 86 and 92, tab 90 is secured by adhesive or other means along the free transverse edge 94 of the outer end panel 84 to a flattened shape. As shown in FIG. 6B, this flattened shape is squared to a rectangular shape hinged at the corners by fold-lines 85, 86, and 87.

Blank 80 further includes inner wall flaps 110–113 connected to the outer wall panels 81–84, respectively, at a longitudinal fold-line 115. The inner wall flaps 110–113 are separated by slots 109 extending around the perimeter of the lid and extend from the free edge of the blank transversely to the longitudinal fold-line 115. The side inner wall flaps 111 and 113 lie adjacent to the end inner wall flaps 110 and 112. Each of the inner wall flaps 110 and 112 and outer wall panels 81 and 83 have die cut oval shaped elongated openings 116, each of which is centered longitudinally of the respective flaps and panels and the fold-line 115 bisects the openings 116. Additionally, each of the inner wall flaps 111 and 113 and outer wall panels 82 and 84 have two die cut oval shaped elongated openings 118, which are centered transversely of the respective flaps and panels. The fold-line 85 bisects the openings 118. To assemble the lid, the inner wall flaps 110–113 are folded inwardly along fold-line 115 and press against the inner wall panels 81–84. In this ,way, the inner walls of the double wall lid press against box 91 (FIG. 6B) to provide a tight interference fit.

Blank 80 further includes flaps 95, 96, 97 and 98 which form the top of the lid. The flaps 95–98 are separated by slots 100 extending from the free edge of the blank transversely to the longitudinal fold-line 102 extending around the perimeter of the lid. The side flaps 96 and 98 lie adjacent to the end flaps 95 and 98. Each of the flaps 95–98 are folded inwardly and secured, e.g., with adhesive, to form the top of the lid. Preferably, the end flaps 95 and 97 are equal in width to the side flaps 96 and 98 and a rectangular opening is formed in the top of the lid. In addition, each of the flaps 95–98 and outer panels 81–84 have die cut oval shaped elongated openings 106, each of which is centered longitudinally of the respective flaps and panels and the fold-line 102 bisects the openings 106. Finally, there are cut-out areas 107 disposed along the adjacent longitudinal free edge of the blank, one centered on each of the inner wall end flaps 110 and 112. The cut-outs 107 correspond to half of the openings 116 and are positioned to register with the openings 116 upon folding the outer panels inwardly along the perimeter fold-line 115.

Referring to FIG. 2C, the double wall lid having gusset style corners is formed from a blank 25 having an outer side panel 26 and adjacent outer end panel 27 hinged along fold-line 28 and joined to outer side panel 29 along fold-line 30. Fold-lines 28, 30, 32 and 39 are panel fold-lines at the end of each of the inner and outer panels. The outer side panel 29 is hingedly connected to outer end panel 31 along fold-line 32. Inner panels are connected to the outer panels 26, 27, 29 and 31 along a longitudinal fold-line 33 extending the length of all of the panels, which provides a perimeter fold-line for the lid wall. The inner side panel 34 is hinged to outer end panel 26, and inner end panel 35 hinged to outer end panel 27. The inner side panel 36 is hinged to outer side panel 29 and inner end panel 37 hinged to outer end panel 31. A tab 38 is joined to the end panels 31 and 37 along a lateral fold-line 39 and tab 38 provides a manufacturer's joint for assembling lid blank 25 to a rectangular shape. Upon folding the blank at the fold-line 30, and tab 38 thereof at fold-line 39, tab 38 is secured by adhesive or other means along the free transverse edge 25*c* of panels 34 and 26 to a flattened shape. As shown in FIG. 6, this is squared to a rectangular shape hinged at the corners by the respective fold-lines 28, 30 and 32.

Blank 25 includes flaps which are separated by slots 40 extending from the free edge of the blank transversely to the longitudinal fold-line 41 extending around the perimeter of the lid and which is parallel to the perimeter fold-line 33. The side flaps 42 and 43 lie adjacent the end flaps 44 and 45. The flaps 42–45 are folded inwardly to form the top of the lid 6. Each of the flaps 42–45 and outer panels 26–31 have die cut oval-shaped elongated openings respective flaps and panels and the fold-line 41 bisects the several openings 46. Additionally, there are cut-out areas 47 disposed along the longitudinal free edge of the blank, one centered on each of the inner panels 34–37. Cut-outs 47 correspond to half of the openings 46 and are positioned to register with the opening 46 upon folding the inner panels inwardly along the perimeter fold-line 33. Preferably, the width of the panels 34–37 equal the width of the panels 26–31. At opposite ends of each of the inner panels 34–37 there are scores defining diagonal fold-lines 48 and 49. The diagonal fold-lines on each such panel radiate from the intersection 50 of the perimeter fold-line 33 with a panel fold line (28, 30, 32 and 39) defining the ends of the panels and diagonal fold-lines 48 and 49 are angled at 45 degrees inwardly of each of the inner panels. The included angle between two adjacent diagonal score lines 48' and 49', for example between flaps 34 and 35, is 90 degrees. The panel fold-line, e.g., line 28, bisects this included angle.

More specifically, each juncture between the inner panels 34, 35, 36 and 37 of the blank 25 provides a gusset-style corner that is defined by the two diagonal lines 48 and 49 radiating in opposite directions from the juncture 50 of the longitudinal fold-line 33 (hinge) and the transverse fold-line (hinge) for the panel, indicated as fold-lines 28, 30, 32 and 39. This is illustrated of FIG. 6C on the blank shown joined to a rectangle form 25*a* in constructing the lid. It should be noted that in this construction, except for the manufacturer's tab and joint, there are no other tabs or the like which are glued or stapled in the make up of the 2-ply perimeter wall of the lid. This is in contrast with other in which all four corners are fastened or stapled to form the perimeter of the side wall of the lid.

Referring to FIGS. 5 through 10, the blank 25 is formed to a rectangular shape by fastening the tab 38 at the one free end of the blank 25 to the inner surface of panels 34, 26 adjacent the other free end 25*c* of the blank. As the blank is closed and fastened, it assumes the shape shown on FIG. 6. In actual practice, the lid 6 is assembled in a collapsed condition about diagonally opposite lateral fold-lines, such as 28, 32 or 30, 39, to a flat form for shipping or storage of the container lid before use.

The HSC bottom 8 of the container 2 is made up in similar fashion by fastening the tab 19 to the end of side panel 12 adjacent to its free end 12*a*. In handling and storage before use, this assembled blank 10 is in flattened form, erected by folding at diagonally opposite transverse fold-lines and securing the bottom flaps to secure the bottom of the box.

Figure 3:
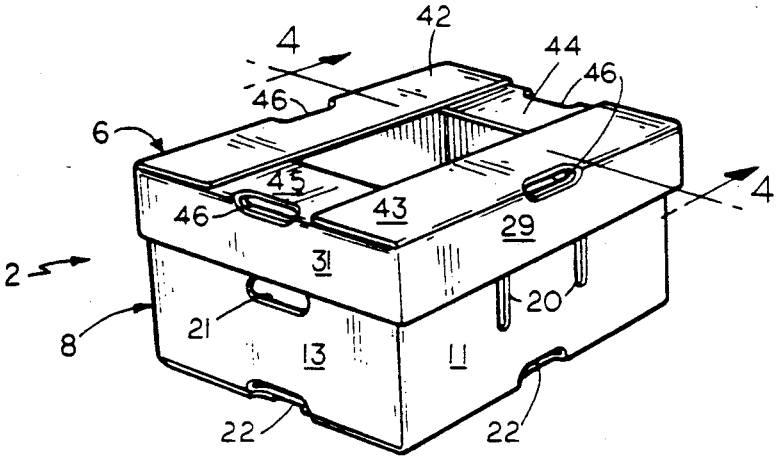
FIG. 3 is a three-quarter perspective view of an assembled HSC container of the invention.
Figure 4:
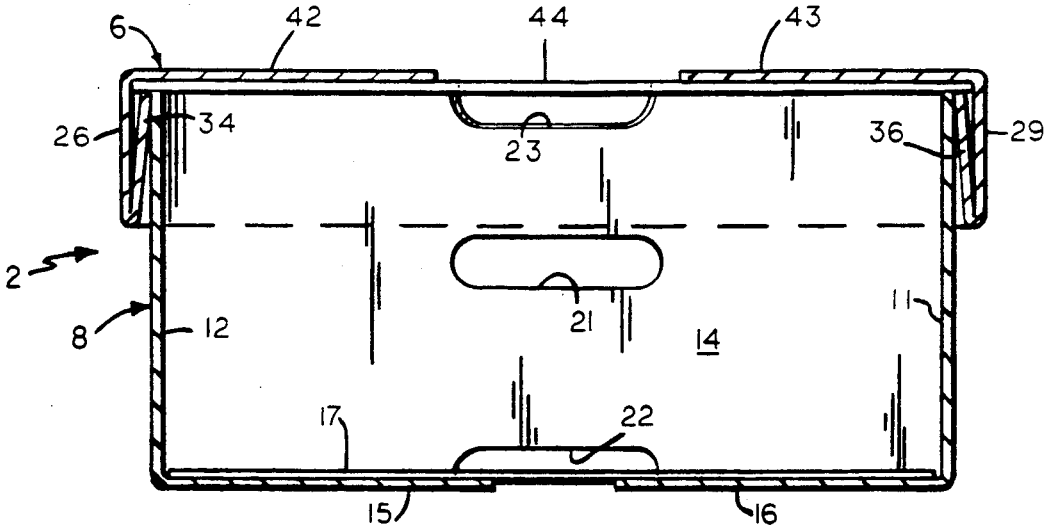
FIG. 4 is a sectional elevation view taken along line 4—4 of FIG. 3.
Figure 5:
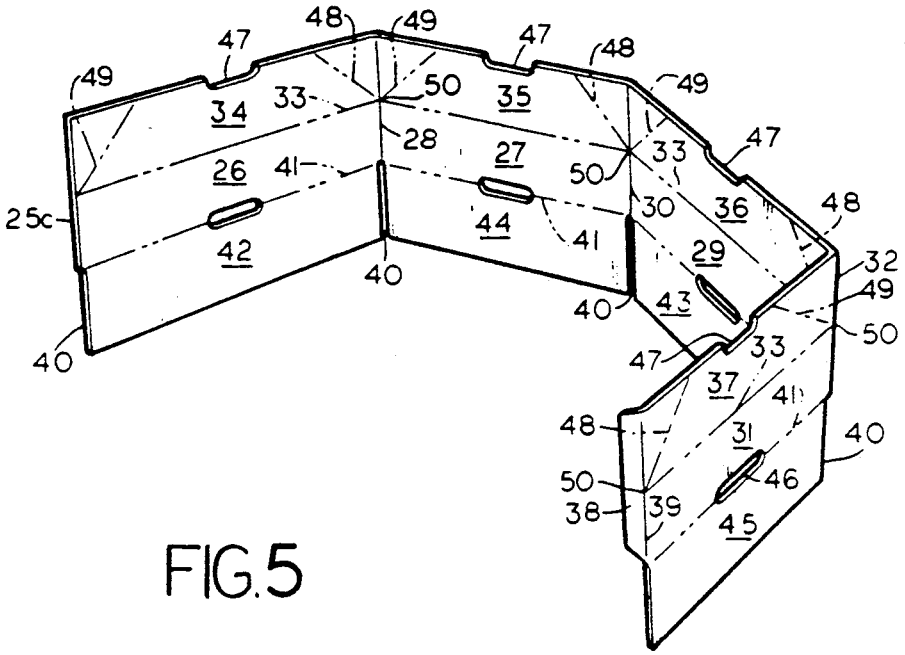
FIGS. 5 is a perspective view of the blank shown in FIGS. 2C illustrating the assembly of the lid.

At the point of use, the bottom box 8 is made up as shown on FIGS. 3 and 4 by folding the bottom side flaps 15 and 16 inwardly, then folding the end flaps 17 and 18 over them. The bottom flaps 15–18 are secured to each other, such as by staples or adhesive, to form a full height bottom portion of the container 2. The flaps 15, 16 when folded do not meet but are spaced apart, as shown on FIG. 4, and similarly the flaps 17, 18 do not meet but are spaced from each other. This provides a centralized opening in the bottom wall of the box 8 for the flow of air. As may be optionally utilized in this style of box, an internal partition (not shown) may be fastened in place to separate the contents and provide compartments. Such practice has been employed for handling of fruit and produce. The lower portion of box 8 of the container also includes the bottom edge apertures 22 extending through the fold-line for the flaps 15–18 and the apertures 22 provide for added flow of air through the bottom wall and lower side wall of the container as well as through the aforementioned bottom opening near the center of the bottom wall.

The lid is assembled as shown on FIGS. 7 through 10. The first stage of assembly includes folding the flaps 42, 43 inwardly and flaps 44, 45 are folded to overlie them. These flaps are fastened together by adhesive or staples to make up the top wall of the lid 25*a*. The end flaps 44, 45 do not touch when folded inwardly to make up the top wall and the side flaps 42, 43 do not meet or touch so that a centralized opening is provided in the top of the lid 25*a*. This opening is best seen on FIGS. 3 and 4.

After the top wall is assembled, the inner end panels 34 and 37 are folded inwardly followed by inner side panels 35 and 36. The diagonal fold-lines 48 and 49 of the gusset-style corners readily permit this folding of the inner flaps inwardly. The four inner panels are joined together as one continuous wall or band or corrugated. Upon setting up the lid, the gusset-style corners permit infolding the panels. The fold-lines 28, 30, 32 and 39 between panels 34–37 extend innermost and near the interior corners of the lid. These fold lines lock the corners in place, and the diagonal fold lines 48 and 49 on either side provide hinges in the inner panels at their ends. The inner panels 34–37 are slightly bowed inwardly by virtue of their dimensions and in use provide a tight, spring-like fit of the perimeter wall of the lid on the lower box (e.g., as in FIG. 4).

As is seen on the finished container, the sides and ends of the lid 6 are each of 2-ply corrugated around the perimeter of the lid, and the spring effect of the walls of the inner panels provide a snug, tight fit of the lid on the box 8. In the preferred example of the disclosed embodiment, the sides and ends of the lid perimeter extend down over approximately one half the vertical height of the side and end walls of box 8. This allows for enhanced channeling of air between containers 2 in the pallet formation of containers (FIGS. 1, 1A and 1B). It also conserves corrugated material and is most cost effective.

Other embodiments are within the following claims.

What is claimed is:

1. A container for ripening fruit during storage and shipment comprising a box having a box bottom wall, a plurality of vertically oriented box side walls and box end walls defining a volume with an open end, a lid for said box having a lid top wall and integral perimeter comprised of a plurality of vertically oriented lid side walls and lid end walls depending therefrom to fit telescopically over the open end of said box, planes of said lid side walls being offset from planes of said box side walls said lid side walls and lid end walls being two-ply comprised of inner and outer panels, the outer panels being hingedly connected to the lip top wall and the inner panels being hingedly connected to the outer panels at a perimeter fold-line, said inner panels being folded inwardly about said perimeter fold-line, each of the inner panels having a hinged connection to the adjacent panel at a panel fold-line, the panel fold-line forming the inner corner of the lid perimeter wall, scored diagonal fold-lines radiating outwardly at the ends of each panel from the intersection of said perimeter fold-line and the panel fold-line, the included angle between said diagonal fold-lines being 90 degrees, the inwardly folded inner panels of said lid perimeter wall being locked at the corners by said diagonal folds and said inwardly folded inner panels being bowed inwardly of the lid perimeter whereby the bowed inner panels engage the box side walls and securely hold the lid on the box against the box side walls and reinforce said box side walls against bulging outwardly;

said container adapted to be stacked in a pallet load with other of said containers, with lid side walls of adjacent said containers in engagement for stable stacking of said containers, and adjacent side walls of adjacent said containers spaced apart in a manner to define a channel between said adjacent containers for circulation of ventilating air or gas to fruit contained within said containers, and for removal of heat generated by respiration of the fruit contained within said containers.

2. The container of claim 1 wherein said container further comprises apertures defined in the box bottom wall, box side walls and box end walls for flow of ventilating air or gas through the volume of the box and apertures defined in the lid side walls and lid end walls for flow of ventilating air or gas into the volume of the box through the lid, the apertures of said lid side walls and lid end walls being adjacent the perimeter fold line for said panels forming said lid top wall.

3. The container of claim 2 wherein said lid top wall defines a central opening and said box bottom wall defines a central opening for flow of ventilating air or gas through said volume of said container.

4. The container of claim 1 wherein said lid is formed of a blank comprising alternating side flaps and end flaps hinged along one of their sides at a first longitudinal fold-line, said side flaps and said end flaps being separated from each other from said fold-line to one longitudinal edge of the blank, a second longitudinal fold line parallel with the first, lateral fold-lines extending from the first longitudinal fold-line to the other longitudinal edge of the blank, said lateral fold-lines defining alternative side panels and end panels and a tab, said tab being disposed at the end of the blank providing a manufactures joint for fastening the blank into a closed perimeter of said lid, said second longitudinal fold-line forming side-by-side inner panels and outer panels disposed lengthwise along one side of the blank, two diagonal fold lines provided by scores in the blank extending from the intersection of each lateral fold-line and the second longitudinal fold line to the adjacent other longitudinal edge of the blank, said two diagonal fold-lines having an included angle of 90 degrees and each extending 45 degrees from said second longitudinal fold line, said diagonal fold lines, together with the lateral fold-line adapted to provide a gusset-style corner for said lid upon folding the inner panels inwardly about said second longitudinal fold-line.

5. The container of claim 4 wherein said blank defines a plurality of apertures formed along the first longitudinal fold line, each said aperture extending into the adjacent flaps and into said outer panels.

6. The container of claim 5 wherein said plural apertures comprise an aperture located at each of said flaps.

7. The container of claim 6 wherein said apertures are centered on the first longitudinal fold line, and said inner panels and said outer panels are substantially equal in width, the inner panels having cut out portions along the edge of the blank located to register with said apertures upon folding the inner flaps along said second longitudinal fold line.

8. The container of claim 7 wherein said apertures are elongated, oval-shaped die cut apertures bisected by said first longitudinal fold line and cut out portions along the edge of the blank are substantially equal to half said oval shaped apertures.

9. The container of claim 1 wherein said lid comprises a lid top wall, a pair of spaced lid side walls and a pair of spaced lid end walls, said lid side walls and said lid end walls being in adjacent relationship, each said lid side wall and lid end wall being formed from inner panels and outer panels joined to each other at their sides along a longitudinal fold line, and joined to each other at their ends at a lateral fold-line to define the corner of said lid, each of the inner panels having a diagonal fold-line extending interiorly of the panel and intersecting said lateral fold-line, the diagonal fold-lines between adjacent inner panels having an included angle of 90 degrees, said inner panels being connected continuously and folded inwardly about said longitudinal fold-line to form a two-ply perimeter wall of said lid, the diagonal fold-lines and lateral fold-line at the ends of the inner panels providing a hinged joint for locking said inner panels in place such that the inner panels bow inwardly toward the center of the lid.

10. The container of claim 9 wherein said inner panels of said lid engage the box side walls and box end walls to provide a snug fit over said box side walls and said box end walls and firmly support said box side walls and said box end walls against bulging.

11. The container of claim 10 wherein said lid panels extend over said box side walls and said box end walls for a part of their vertical height when said box is closed.

12. The container of claim 11 wherein said lid panels extend approximately one half the vertical height of said box side walls and said box end walls.

13. The container of claim 12 wherein said box side walls and said box end walls have apertures for flow of air through the volume of said box and the panels of the perimeter wall of said lid are die cut to provide apertures at the sides and ends of the perimeter wall of the lid.

* * * * *

UNITED STATES PATENT AND TRADEMARK OFFICE

CERTIFICATE OF CORRECTION

PATENT NO. : 5,121,877

DATED : June 16, 1992

INVENTOR(S) : Michael G. Bodary et al

It is certified that error appears in the above-indentified patent and that said Letters Patent is hereby corrected as shown below:

Col. 1, lines 6, "189" should be --1989--.

Signed and Sealed this

Fifth Day of October, 1993

Bruce Lehman

*Attest:*

BRUCE LEHMAN

*Attesting Officer*

*Commissioner of Patents and Trademarks*